US011623719B2

(12) United States Patent
Pinfold

(10) Patent No.: US 11,623,719 B2
(45) Date of Patent: Apr. 11, 2023

(54) TRACTION KITE APPARATUS AND RELATED METHODS

(71) Applicant: NORTH KITEBOARDING AUSTRALASIA LIMITED, Auckland (NZ)

(72) Inventor: Hugh John Norman Pinfold, Raglan (NZ)

(73) Assignee: NORTH KITEBOARDING AUSTRALASIA LIMITED, Auckland (NZ)

( * ) Notice: Subject to any disclaimer, the term of this patent is extended or adjusted under 35 U.S.C. 154(b) by 332 days.

(21) Appl. No.: 16/694,780

(22) Filed: Nov. 25, 2019

(65) Prior Publication Data

US 2020/0164955 A1 May 28, 2020

Related U.S. Application Data

(60) Provisional application No. 62/772,010, filed on Nov. 27, 2018.

(51) Int. Cl.

| | |
|---|---|
| ***B63H 8/18*** | (2020.01) |
| ***B63H 8/16*** | (2020.01) |
| *B63H 8/50* | (2020.01) |

(52) U.S. Cl.

CPC ..... *B63H 8/18* (2020.02); *B63H 8/16* (2020.02); *B63H 8/50* (2020.02)

(58) Field of Classification Search

CPC .... B63H 8/16; B63H 8/18; B63H 8/50; F16B 21/04

See application file for complete search history.

(56) References Cited

U.S. PATENT DOCUMENTS

| | | | | | |
|---|---|---|---|---|---|
| 3,729,040 | A * | 4/1973 | Whiteside | F16B 37/042 | 411/103 |
| 3,897,162 | A * | 7/1975 | Havark | G09F 3/0364 | 403/353 |
| RE30,801 | E * | 11/1981 | Gley | F16B 21/04 | 411/349 |
| 4,442,571 | A * | 4/1984 | Davis | F16B 5/10 | 24/586.1 |
| 4,964,594 | A * | 10/1990 | Webb | B64C 1/12 | 244/129.3 |
| 4,991,271 | A * | 2/1991 | Bauer | B60P 7/08 | 24/595.1 |
| 5,843,177 | A * | 12/1998 | Vanney | A61F 2/2496 | 606/108 |
| 6,691,954 | B1 * | 2/2004 | Harrington | B63H 8/18 | 244/155 A |

(Continued)

FOREIGN PATENT DOCUMENTS

WO WO-2018042113 A1 * 3/2018 ..... B63H 8/18

*Primary Examiner* — Christopher D Hutchens
(74) *Attorney, Agent, or Firm* — Michael Soderman

(57) ABSTRACT

A traction kite anchoring device for attachment to a harness worn by a user to transfer force from a traction kite to the user. The traction kite anchoring device comprising a first member at an end of at least one line connected to a said kite and a chicken loop for attachment to a said harness and releasably connected to said first member, wherein the chicken loop has a first end comprising an anchor able to be received and secured at an anchor receiver of the first member in a releasable and tool-less manner.

22 Claims, 12 Drawing Sheets

(56) References Cited

U.S. PATENT DOCUMENTS

| | | | | |
|---|---|---|---|---|
| 6,830,220 | B2 * | 12/2004 | Runyan | B63H 8/18 244/155 A |
| 6,869,047 | B2 * | 3/2005 | Pouchkarev | B63H 8/18 244/155 A |
| 6,988,694 | B2 * | 1/2006 | Barrs | B63H 8/18 244/155 A |
| 7,127,781 | B2 * | 10/2006 | Ponting | B63H 8/16 24/136 R |
| 7,147,399 | B2 * | 12/2006 | Viscount | A63C 19/062 403/349 |
| 7,661,215 | B2 * | 2/2010 | Okamoto | G09F 7/18 40/620 |
| 7,841,122 | B1 * | 11/2010 | Hansen | F41A 23/08 42/94 |
| 10,843,777 | B2 * | 11/2020 | McLean | B63H 8/54 |
| 2004/0159747 | A1 * | 8/2004 | Runyan | B63H 8/56 244/155 A |
| 2005/0079010 | A1 * | 4/2005 | Droppleman | F16B 21/04 403/348 |
| 2007/0092333 | A1 * | 4/2007 | Viscount | A63C 19/062 403/349 |
| 2009/0028660 | A1 * | 1/2009 | Csik | F16B 21/04 411/103 |
| 2010/0284767 | A1 * | 11/2010 | Shue | C03B 9/165 411/553 |
| 2019/0193820 | A1 * | 6/2019 | Roger | B63H 8/56 |
| 2020/0130788 | A1 * | 4/2020 | McLean | B63H 8/54 |

* cited by examiner

TRACTION KITE APPARATUS AND RELATED METHODS

PRIORITY CLAIM

This application claims the right of priority to U.S. Provisional Application No. 62/772,010 filed on Nov. 27, 2018, the entirety of the contents of which are hereby incorporated by reference.

FIELD OF THE INVENTION

The present invention relates to apparatus and methods for use in wind-driven propulsion using a traction kite. More particularly but not solely, the present invention relates to an anchor device and chicken loop for connecting a user to a traction kite and to such anchor devices and chicken loops having a tool-less engagement and dis-engagement relationship.

BACKGROUND TO THE INVENTION

Ancient and medieval sources describe kites being used for measuring distances, testing the wind, signaling, and communication for military operations. The advent of powered aircraft diminished some interest in kites, but kites have remained popular for recreational uses.

More recently, traction kites have become popular in personal transportation, sporting, and leisure activities. These kites may be in the form of for example, foils or leading-edge inflatables. These kites are commonly used in kite surfing with a board such as a dedicated kite board or a surfboard.

When using a traction kite in an activity such as kite surfing, the user is commonly connected to the front lines of the kite. These lines are the primary load bearing lines. The user then selectively controls the angle of attack of the kite, and its position in the sky above the user, by sheeting in or out control lines associated with the trailing edge of the kite.

A user commonly wears a harness, which is then connected to the load bearing lines of the kite. For the safety of the user, it is common to provide for various releases, so that the kite may be saved or released from the user if they are in danger or out of control.

A commonly utilised interface between the user and the load bearing lines of the kite is a loop of an elongate flexible material that connects at both its ends to an anchor to which the lines are connected. This loop is commonly known as a chicken loop. The chicken loop is able to be hooked onto the harness of the user to connect the harness and the user to the kite. One end of the chicken loop may be able to be selectively released from the anchor to detach the harness and anchor and to separate the user from the kite. The other end of the chicken loop is fixedly connected to the anchor.

Under various conditions it may be desirable to switch or replace the chicken loop. For example, the chicken loop may become worn due to friction with the harness hook or other use and needs to be replaced as a matter of safety. Chicken loops may also come in different lengths, be made of different materials, have colour schemes, or have different supplementary features. Accordingly, in different situations it may be desirable to change the chicken loop to facility different styles of board riding or characteristics or preferences of the user or of the kite. A tool such as an Allen-Key or screw driver is typically used to secure a chicken loop to an anchor using a threaded fastener of the anchor. This can be time consuming and require the user to have such a tool on them. The replacement or interchanging of chicken loops can hence be frustrating for users.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

For the purpose of this specification, where method steps are described in sequence, the sequence does not necessarily mean that the steps are to be chronologically ordered in that sequence, unless there is no other logical manner of interpreting the sequence.

It may be an object of the present invention to provide a traction kite apparatus and related methods, which overcomes or at least partially ameliorates some of the above-mentioned disadvantages or which at least provides the public with a useful choice.

Alternatively or additionally it may be an object of the present invention to provide a toollessly-changeable chicken loop for a traction kite anchor device.

Alternatively or additionally it may be an object of the present invention to provide a kit of parts for use as an anchoring device for a traction kite, where a chicken loop of the kit of parts is able to be toollessly engaged with and disengaged from another part of the anchor device.

Alternatively or additionally it may be an object of the present invention to provide a method for tool less disengaging of a chicken loop of a traction kite anchoring device.

Alternatively or additionally it may be an object of the present invention to provide a method for tool less engaging of a chicken loop of a traction kite anchoring device.

SUMMARY OF THE INVENTION

In a first aspect, the present invention may be said to broadly consist in a traction kite anchoring device for attachment to a harness worn by a user to transfer force from a traction kite to the user, the traction kite anchoring device comprising a first member at an end of at least one line connected to a said kite and a chicken loop for attachment to a said harness and releasably connected to said first member, wherein the chicken loop has a first end comprising an anchor able to be received and secured at an anchor receiver of the first member in a releasable and tool-less manner.

Preferably the anchor and the anchor receiver are shaped and configured to mutually provide an interference fit when the anchor is received and secured at the anchor receiver to prevent movement of the first member relative the anchor in a direction of said force towards the user (eg when the anchor device is in tension).

Preferably the anchor receiver is a receptacle of the first member.

Preferably the first end is engaged with the receptacle of the first member in a directional interference fit.

Preferably the first end is received at the receptacle of the first member by a first discrete maneuvering of the first end relative the first member, and the first end is secured at the receptacle with the first member by a second discrete maneuvering of the first end relative the first member.

Preferably the anchor is received at and engaged with the anchor receiver (eg receptacle) or by a series of discrete translational, rotational, or combined translational and rotational movements of the anchor relative to the first member.

Preferably the anchor is received at the anchor receiver (eg receptacle) by a first translational movement of the anchor relative the first member.

Preferably the first translational movement of the anchor is a substantially longitudinal translational movement of the anchor relative the first member.

Preferably the anchor is engaged with the anchor receiver (eg receptacle) by a substantially longitudinal rotational movement of the anchor relative the first member.

Preferably the anchor is engaged with the anchor receiver (eg receptacle) by a substantially longitudinal rotational movement of the anchor relative the first member and a second translational movement of the anchor relative the first member.

Preferably the anchor is a) received at the receptacle by a first translational movement of the anchor relative the first member, and b) secured at the receptacle by i. a rotational movement of the anchor relative the first member, and ii. a second translational movement of the anchor relative the first member, being a translational movement opposite the first translational movement.

Preferably the anchor becomes secured at the receptacle by a twist-lock action of the anchor relative to the first member.

Preferably the anchor becomes secured at the receptacle by an insert—twist-lock action of the anchor relative to the first member.

Preferably the receptacle comprises a port.

Preferably the anchor and the receptacle of the first member together define a bayonet connector.

Preferably the anchor defines a male part of the bayonet connector and the anchor receiver (eg receptacle) defines a female part of the bayonet connector.

Preferably the anchor defines a female part of the bayonet connector and the anchor receiver (eg receptacle) defines a male part of the bayonet connector.

Preferably the anchor has at least one radial projection for engagement with a slot of the receptacle.

Preferably the anchor and the anchor receiver (eg receptacle) when engaged with each other are in a material interference fit to prevent release of the anchor from the first member when the kite is in use flying in the air.

Preferably a bias is provided to bias the anchor, once engaged with the anchor receiver (eg receptacle), into engagement with the anchor receiver).

Preferably one of the anchor and the anchor receiver (eg receptacle) comprise a bias element for biasing the anchor into engagement with the anchor receiver.

Preferably a removal of the anchor from engagement with the anchor receiver comprises a movement against the bias of the anchor into engagement with the anchor receiver.

Preferably a receiving of the anchor by the anchor receiver comprises a movement against the bias of the anchor into engagement with the anchor receiver.

Preferably the anchoring device is for attachment between the harness worn by a user and the kite, to transfer force from the kite to the user.

Preferably the end or ends of the at least one line connected to the kite are of load bearing lines of the kite.

Preferably the anchoring device is able to be attached to a said harness worn by a user by the chicken loop, the direction of the force of the kite is away from the user, and the engagement of the anchor with the anchor receiver presents an interference to the movement of the first member relative the harness-attached anchor and in the direction of the force of the traction kite.

Preferably the chicken loop has a second end and that is able to be engaged in a quick release manner to the first member.

In a second aspect the present invention may be said to be a method of engaging and/or replacing a chicken loop of a traction kite anchoring device, the anchoring device comprising a chicken loop to be engaged at an anchor of a first end of the chicken loop with a first member, the method comprising, after removal of any previously used chicken loop, the steps of a) first, translating the anchor relative the first member in a first direction and b) second, moving (preferably rotating) the anchor relative the first member, wherein the anchor when in its engaged condition is encouraged to be retained in engagement with the first member by a bias provided from the first member on the anchor.

Preferably the first and/or second motions are against a bias provided from the first member on the anchor.

Preferably the first and/or second motions are against a bias provided from the first member on the anchor that is the same as the bias applied when in the engaged condition.

Preferably the method further comprises the step of (c) translating the anchor relative the first member in a direction opposite the first direction to engage the anchor with the first member.

Preferably the engagement of the anchor of the chicken loop with the first member involves a bayonet connection relationship between the anchor and first member.

Preferably the steps of the method are performed by a user using their hand or hands.

Preferably the steps of the method are performed by a user using their hands, exclusive of any other tool.

In yet a further aspect the present invention may be said to be a method of disengaging a chicken loop of a traction kite anchoring device, the anchoring device comprising a chicken loop engaged at an anchor of a first end of the chicken loop with a first member, the method comprising the steps of a) moving (eg rotating) the anchor relative the first member and then b) translating the anchor relative the first member in a direction opposite a first direction to separate the anchor from the first member.

Preferably the method further comprises a step before step (a) of step (al) being a translating of the anchor relative the first member in a first direction.

Preferably the translating of step (al) comprises at least in part a translation against a bias provided from the first member to the anchor to encourage them into engagement with each other.

Preferably the engagement of the anchor of the chicken loop with the first member comprises a bayonet connection.

Preferably the steps of the method are performed by a user using their hand or hands.

Preferably the steps of the method are performed by a user using their hands, exclusive of any other tool.

In yet a further aspect the present invention may be said to be a kit of parts for use as an anchoring device for a traction kite, the anchoring device for attachment to a harness worn by a user to transfer force from a kite to the user, the kit of parts comprising a first member connected with or for connection to an end of at least one line connected to a said traction kite, and a chicken loop comprising a first end and a second end, each end for association with the first member so as to, between the ends, present a loop for attachment to a said harness worn by a user, wherein the first end is able to be received at and engaged with a first end receiver of the first member in a releasable and tool-less manner.

Preferably the first end is able to be received at and engaged with a receptacle of the first member in a releasable and tool-less manner to present an interference to movement of the anchor in a direction of said force.

Preferably the first end is threadingly engaged with said first member.

Preferably the first end is engaged with the first member in a bayonet fitting manner.

Preferably the first end is to be engaged with the first end receiver of the first member in a directional interference fit.

Preferably the first end is to be received at the first end receiver of the first member by a first discrete maneuvering of the first end relative the first member, and the first end is to be engaged with the first end receiver of the first member by a second discrete maneuvering of the first end relative the first member.

Preferably the first end is defined by an anchor.

Preferably the anchor is to be received at and engaged with the first end receiver by a series of discrete translational, rotational, or combined translational and rotational movements of the anchor relative to the first member.

Preferably the anchor is to be received at the first end receiver by a first translational movement of the anchor relative the first member.

Preferably the first translational movement of the anchor is a substantially longitudinal translational movement of the anchor relative the first member.

Preferably the anchor is to be engaged with the first end receiver by a substantially longitudinal rotational movement of the anchor relative the first member.

Preferably the anchor is to be engaged with the first end receiver by a substantially longitudinal rotational movement of the anchor relative the first member and a second translational movement of the anchor relative the first member.

Preferably the anchor is:

a) to be received at the first end receiver by a first translational movement of the anchor relative the first member, and b) to be engaged with the receptacle by i. a rotational movement of the anchor relative the first member, and ii. a second translational movement of the anchor relative the first member, being a translational movement opposite the first translational movement.

Preferably the anchor is to be received at the first end receiver by a twistlock action relative to the first member.

Preferably the first end receiver is a receptacle and may comprise a port.

Preferably the anchor and the first end receiver of the first member together define a bayonet connector.

Preferably the anchor defines a male part of the bayonet connector and the first end receiver defines a female part of the bayonet connector.

Preferably the anchor defines at least one radial projection for engagement with a slot of the first end receiver.

Preferably the anchor and the receptacle when engaged with each other are in a material interference fit.

Preferably a bias is provided from the first member to the anchor to bias the anchor, once engaged with the anchor receiver (eg receptacle), into engagement with the receptacle.

Preferably one of the anchor and the receptacle comprise a bias element for biasing the anchor into engagement with the receptacle.

Preferably a removal of the anchor from engagement with the receptacle comprises a movement against the bias of the anchor into engagement with the receptacle.

Preferably a receiving of the anchor by the receptacle comprises a movement against the bias of the anchor into engagement with the receptacle.

Preferably the anchoring device is for attachment between the harness to be worn by a user and the kite, to transfer force from the kite to the user.

Preferably the end or ends of the at least one line connected to the traction kite are of load bearing lines of the traction kite.

Preferably the anchoring device is attached to a said harness to be worn by a user by the chicken loop, the direction of the force of the traction kite is away from the user and harness, and the engagement of the anchor with the receptacle presents an interference to the movement of the first member relative the harness-attached anchor and in the direction of the force of the traction kite.

Preferably the kit of parts includes at least two chicken loops each able to be selectively engaged to the first member in a tool-less and releasable manner.

Preferably each of the at least two chicken loops are different to each other.

In yet a further aspect the present invention may be said to be a kite anchoring device comprising a first member at the end of at least one line connected to a kite and a chicken loop, the first member and the chicken loop engaged or engageable to each other by way of a bayonet connection.

Preferably a bias is provided to bias the anchor into engagement with the receptacle.

Preferably one of the anchor and the receptacle comprise a bias element for biasing the anchor into engagement with the receptacle.

Preferably a removal of the anchor from engagement with the receptacle comprises a movement against the bias of the anchor into engagement with the receptacle.

Preferably a receiving of the anchor by the receptacle comprises a movement against the bias of the anchor into engagement with the receptacle.

Preferably the anchor defines a male part of the bayonet connector and the receptacle defines a female part of the bayonet connector.

Preferably the anchor defines at least one radial projection for engagement with a slot of the receptacle.

Preferably the anchor and the receptacle when engaged with each other are in a material interference fit.

In yet a further aspect the present invention may be said to be a kite anchoring device comprising a first member at the end of at least one line connected to a kite and a chicken loop, the first member and the chicken loop engaged or engageable to each other by way of a threaded connection.

In yet a further aspect the present invention may be said to be a kite anchoring device comprising a first member at the end of at least one line connected to a kite and a chicken loop, the first member and the chicken loop engaged or engageable to each other by way of a hooked connection.

In yet a further aspect the present invention may be said to be a toollessly-changeable chicken loop for a kite anchoring device, the chicken loop comprising a first end configured for a releasable and tool-less bayonetted connection to the kite anchoring device.

In yet a further aspect, the present invention may be said to broadly consist in a traction kite anchoring device for attachment to a harness worn by a user to transfer force from a traction kite to the user, the traction kite anchoring device comprising a first member at an end of at least one line connected to a said kite and a chicken loop for attachment to a said harness and releasably connected to said first member, wherein the chicken loop has a first end comprising an anchor able to be locked and unlocked to and from the first member in a manner that is tool-less and/or does not require the use of a grub screw or bolt or machine screw.

Preferably the securing of the chicken loop to the first member does not require the use of additional fasteners.

In yet a further aspect the present invention may be said to be a toollessly-changeable chicken loop substantially as herein described with reference to any one or more of the figures.

In yet a further aspect the present invention may be said to be a traction kite anchoring device substantially as herein described with reference to any one or more of the figures.

In yet a further aspect the present invention may be said to be a kit of parts for use as an anchoring device for a traction kite substantially as herein described with reference to any one or more of the figures.

In yet a further aspect the present invention may be said to be a method of engaging a chicken loop of a traction kite anchoring device substantially as herein described with reference to any one or more of the figures.

In yet a further aspect the present invention may be said to be a method of disengaging a chicken loop of a traction kite anchoring device substantially as herein described with reference to any one or more of the figures.

The term "axis" as used in this specification means the axis of revolution about which a line or a plane may be revolved to form a symmetrical shape. For example, a line revolved around and axis of revolution will form a surface, while a plane revolved around and axis of revolution will form a solid.

As used herein the term "and/or" means "and" or "or", or both.

As used herein "(s)" following a noun means the plural and/or singular forms of the noun.

The term "comprising" as used in this specification [and claims] means "consisting at least in part of". When interpreting each statement in this specification [and claims] that includes the term "comprising", features other than that or those prefaced by the term may also be present. Related terms such as "comprise" and "comprises" are to be interpreted in the same manner.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

Other aspects of the invention may become apparent from the following description which is given by way of example only and with reference to the accompanying drawings.

BRIEF DESCRIPTION OF THE DRAWINGS

Preferred embodiments of the invention will be described by way of example only and with reference to the drawings, in which.

DETAILED DESCRIPTION OF PREFERRED EMBODIMENTS

Figure 1A:
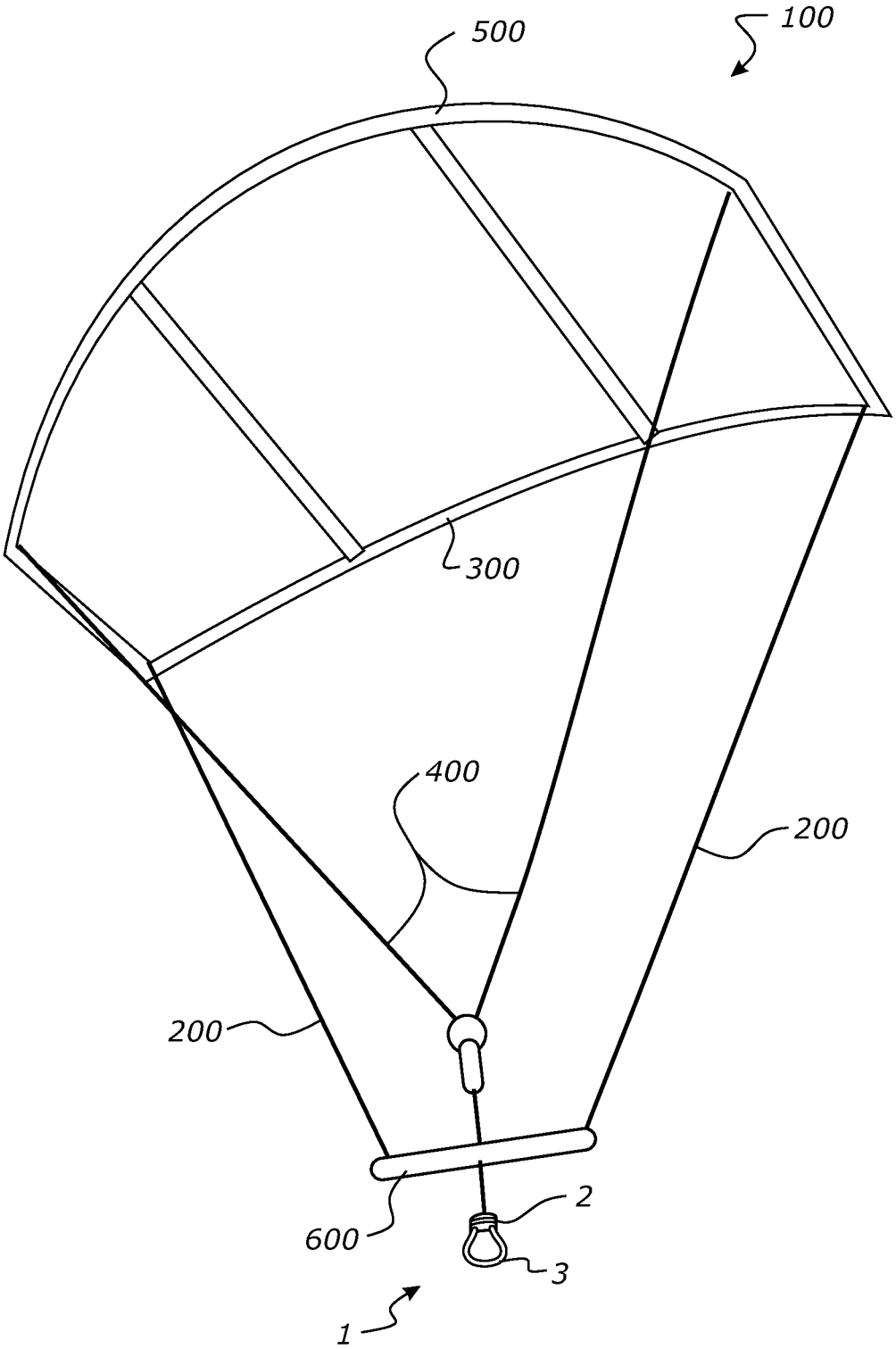
FIG. 1A shows a traction kite with power lines and control lines, a control bar and anchoring device and loop.
Figure 1B:
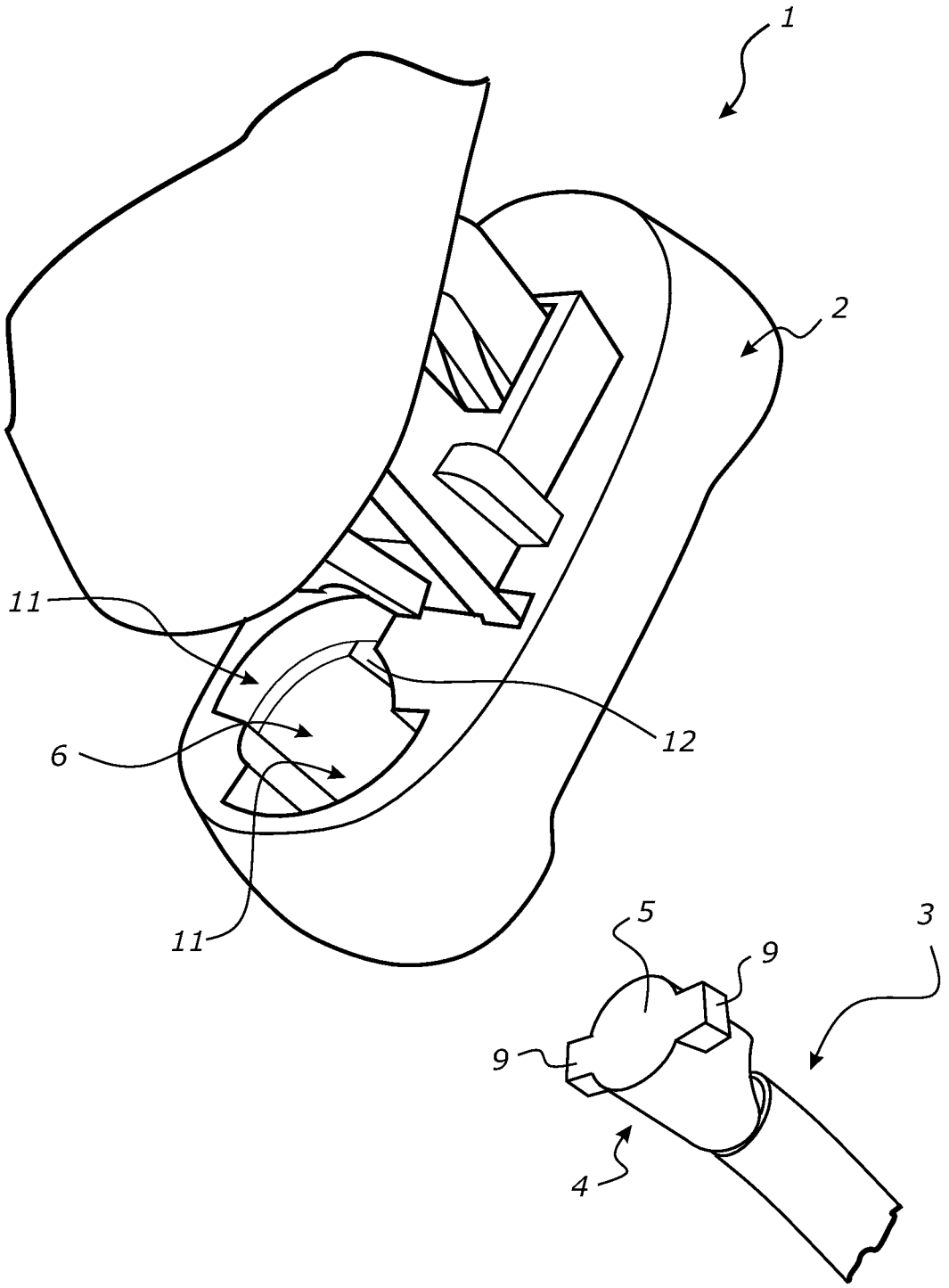
FIG. 1B shows a partial view of a traction kite anchoring device according to an embodiment of the invention.

The present invention relates to kites, a typical set-up of a kite 100 such as a traction kite being shown in FIG. 1A. The kite 100 is able to be controlled for motion in the air by control lines. Rear control lines 200 extend from or near the trailing edge 300 of the kite 100 and to a control bar 600. Front lines 400 extend from the leading edge 500 of the kite 100 directly or indirectly to an anchoring device 1.

A partial view of an anchoring device 1 according to an embodiment of the invention is shown in Figure IB. The anchoring device 1 is for attachment to a harness worn by a user, to transfer force from the traction kite to the user. The harness may present a hook for releasable connection to the anchoring device. As seen in FIG. 1A, the traction kite anchoring device 1 comprises a first member 2. The first member 2 is at an end of at least one line connected to a traction kite. For example, the first member 2 maybe at the end of the at least one front line, being the main load bearing line, of a traction kite.

The anchor device 1 further comprises, or is for use with, a chicken loop 3. A partial view of a chicken loop 3, showing a first end and 4 of the chicken loop 3 is seen in FIG. 1A.

The first end 4 of the chicken loop 3 comprises an anchor 5. The anchor 5 is able to be received at, an engaged with, a receptacle 6 of the first member 2.

The receiving and engaging of the anchor 5 by the receptacle 6 is preferably in a releasable manner and preferably not requiring a tool (ie, engaging and releasing is toolless). The engagement between the anchor 5 and receptacle 6 is such as to present an interference to the movement of the first member 2 relative to the anchor 5. The force is one experienced by the anchor when the kite is flying and harness is connected to the loop. The anchor is in tension due to the forces in such use conditions.

The anchor 5 and the receptacle 6 of the anchor device may additionally or alternatively be described to be in a geometry locking condition, when engaged with each other. For example, the geometry of the anchor 5 and receptacle 6 may be such that, under certain conditions, they may be caused to hold against each other to restrain relative movement to at least a degree sufficient to prevent their separation.

In an embodiment such as shown in FIGS. 1-4, for example, the anchor 5 comprises bayonet features, and the receptacle 6 comprises slots 11 and secondary slots 12. These features are able, when the anchor is inserted into the first member 2 and rotated relative to it, to provide a geometry locking relationship.

Figure 2:
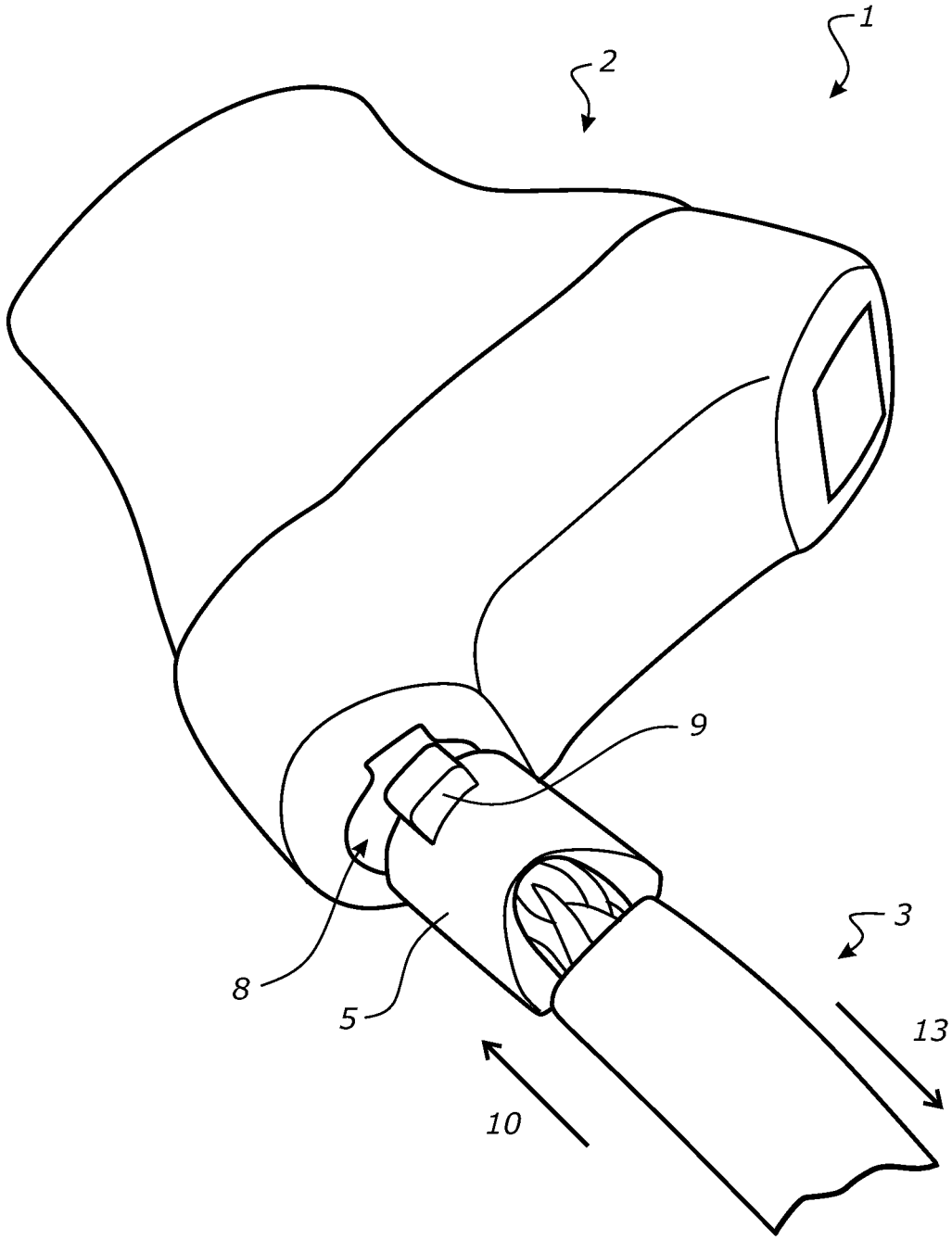
FIG. 2 shows another view of the traction kite anchoring device of FIG. 1A.
Figure 3:
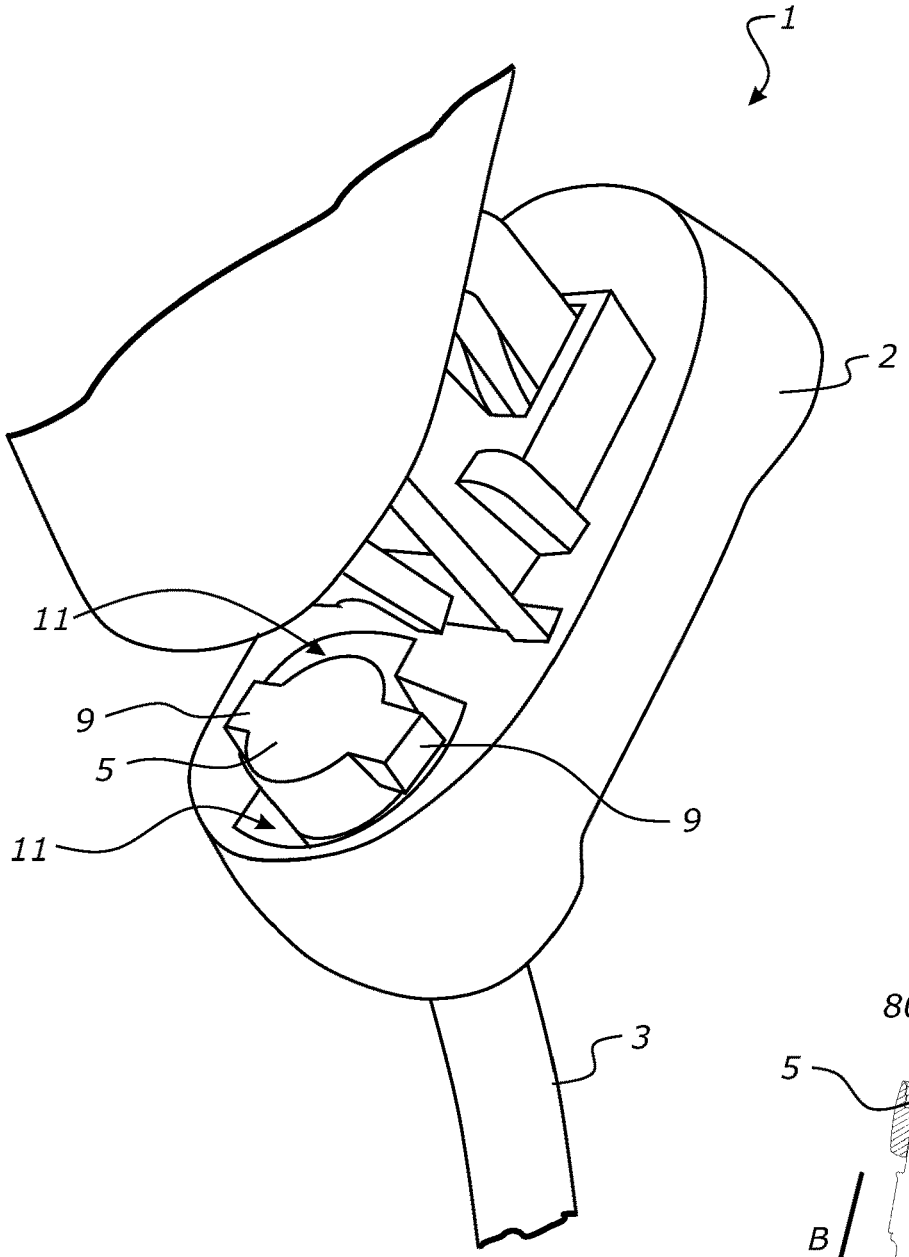
FIG. 3 shows the configuration of FIG. 1A where an anchor has been received at a first member.
Figure 4:
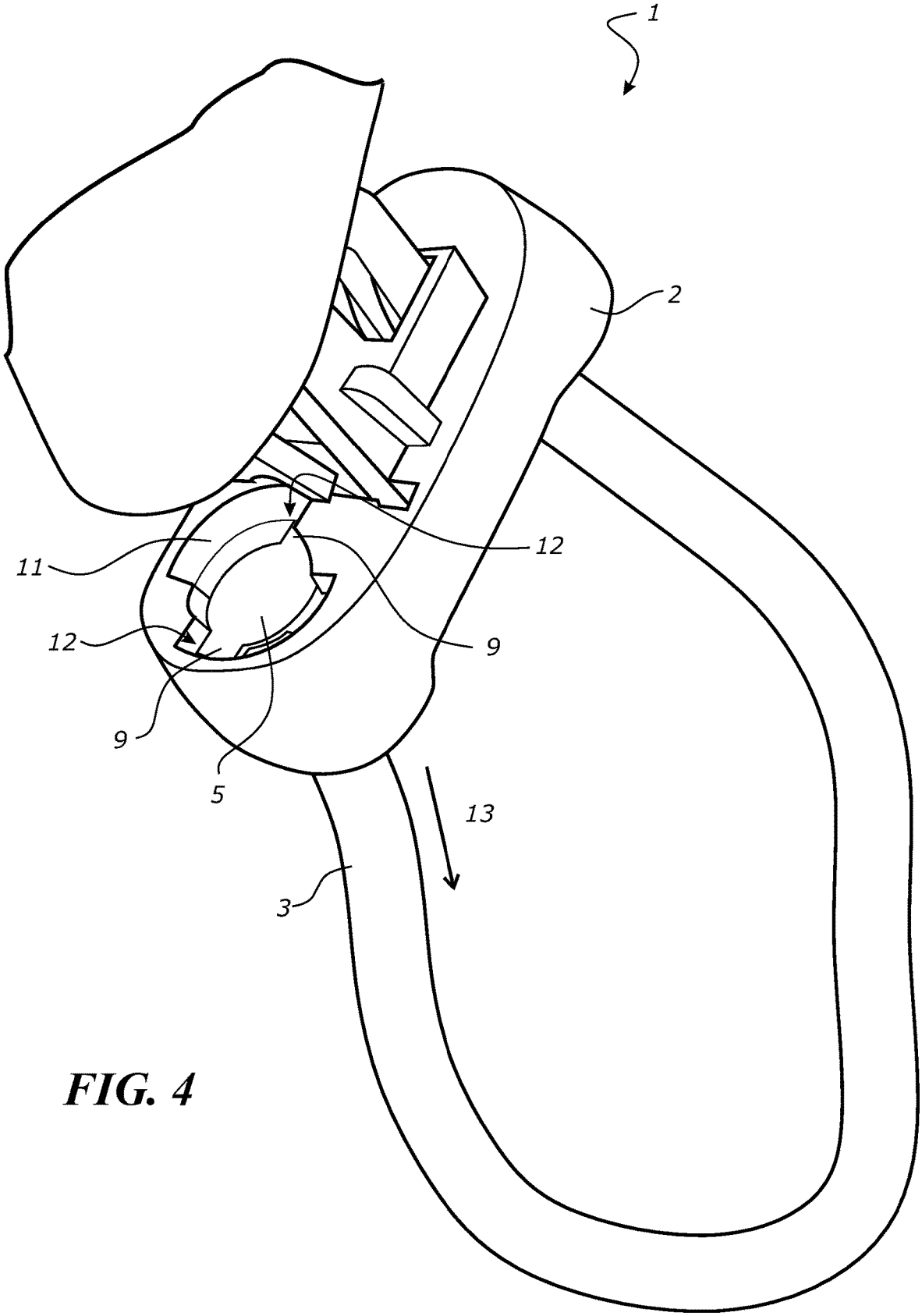
FIG. 4 shows the configuration of FIG. 1A and FIG. 3 where an anchor has been received at and engaged with a first member.

As shown in FIG. 1A, the first member 2 and chicken loop 3 are not engaged with each other. FIGS. 2 to 4 shown a process of receiving and engagement of the anchor 5 within the receptacle 6 according to an embodiment of the invention. Alternatively, in reverse order FIGS. 2 to 4 show a process of disengagement of an anchor 5 with a receptacle 6.

With reference to FIG. 2, another view of the anchor device 1 and first member 2 is shown. The first member 2 in this configuration comprises, as part of the receptacle 6, a port 8 for receiving the anchor 5 of the first member 4 of the chicken loop 3. The port 8 is preferably of a complimentary cross section to the cross section of the anchor 5 to allow the anchor 5 to pass into the port 8. Preferably the port is of a slightly larger size to the anchor so that the anchor can snugly enter the port.

As seen in FIG. 2 the anchor 5 comprises at least one projection 9.

The first end 4 and its anchor 5 are inserted into and received by the port 8 of the first member 2 by a movement of the first end 4 in the direction of the arrow 10.

FIG. 3 shows a view the anchor 5 inserted into the first member 2. Visible in FIG. 3 are the two projections 9 of the anchor 5 and corresponding slots or channels 11 of the first member 2. As seen in FIG. 3, the anchor 5 has been received within the receptacle 6.

According to the embodiment of FIGS. 1 to 4, the anchor 5 is engaged with the receptacle 6 of the member 2 upon a rotation of the anchor 5 within the receptacle 6. As seen in FIG. 4, the anchor 5 has been rotated through approximately 90 degrees. The projections 9 of the anchor 5 travel along the slots of channels 11. In the rotated position shown in FIG. 4 the receptacle 6 does not have voids below the projections 9, as the port 8 does for the insertion of the anchor 5. In the rotated position, the projections 9 of the anchor 5 interfere with the first member 2, so as to present an interference to the movement of the first member relative the anchor in a direction of the arrow 13.

In various forms, locking engagement the anchor 5 with the receptacle 6 may involve both the rotational of the anchor 5 relative the receptacle, and translation of the anchor 5 relative the receptacle 6. For example, as seen in FIG. 4, to engage the anchor 5 in the receptacle 6 after a rotation of the anchor 5, the first end 4 of the chicken loop may be moved in the direction of the arrow 13 relative to the first member 2, to lock it in place.

This movement in the direction of the arrow 13 may allow the projections 9 to enter secondary slots 12 of the receptacle 6. The interaction of the projection 9 with the secondary slots 12 may provide further locking engagement of the anchor 5 with the first member 2 and act to prevent or resist the rotation of the anchor 5 back to a position from which it can be pulled from the first member 2 in the direction of the arrow 13.

Figure 5:
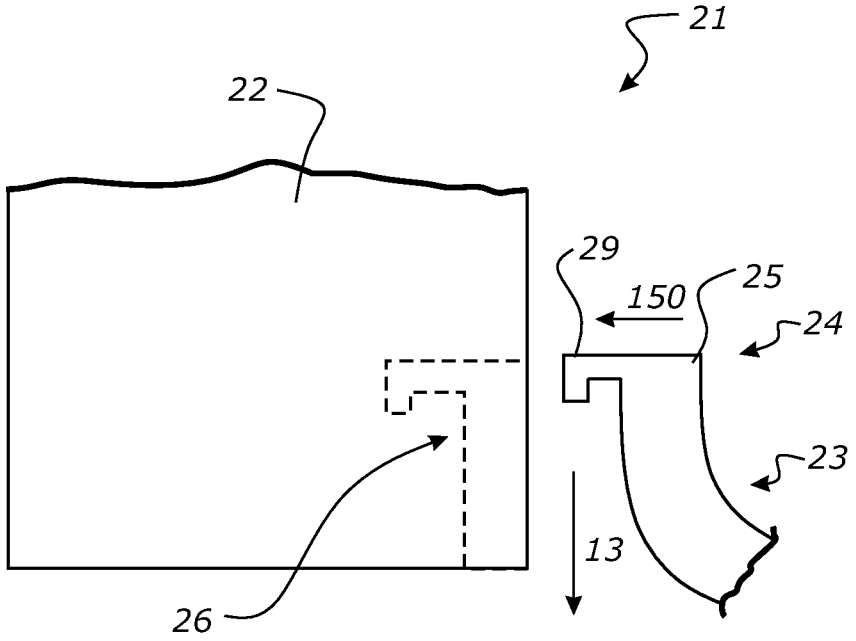
FIG. 5 shows a side view of another embodiment of a traction kite anchoring device according to the invention.
Figure 6:
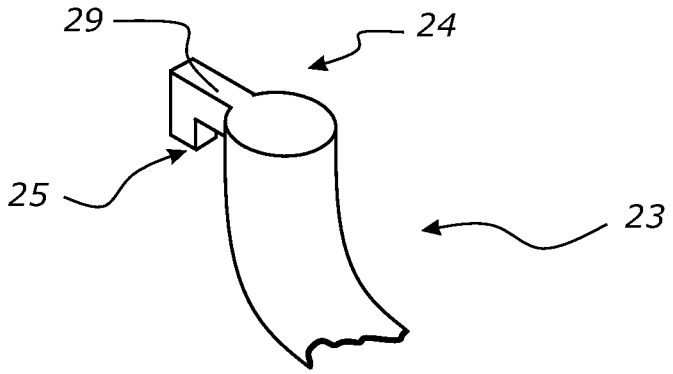
FIG. 6 shows a perspective view of an anchor of the embodiment of FIG. 5.

Another embodiment of anchor device 21 is shown in FIGS. 5 and 6. In the configuration of the embodiment of FIG. 5, the anchor 25 of the first end 24 of the chicken loop 23 is received by the receptacle 26 of the first member 22 by a side entry rather than a bottom entry, as was described in relation to FIGS. 1 to 4. When received by the receptacle 26, the projection 29 of the anchor 25 engages with the receptacle to present interference to the movement of the first member 22 relative the anchor 25 in the direction of the arrow 10.

FIG. 6 shows a partial perspective view of the first end 24 of the chicken loop 23, with its anchor 25 and single projection 29.

Figure 3A:
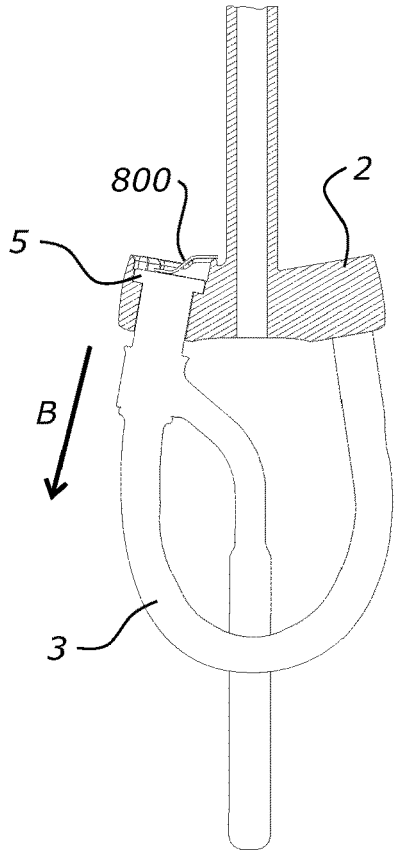
FIG. 3A shows a first member and anchor engaged and a leaf spring acting on the anchor to bias it into its engaged condition with the receptacle.
Figure 3B:
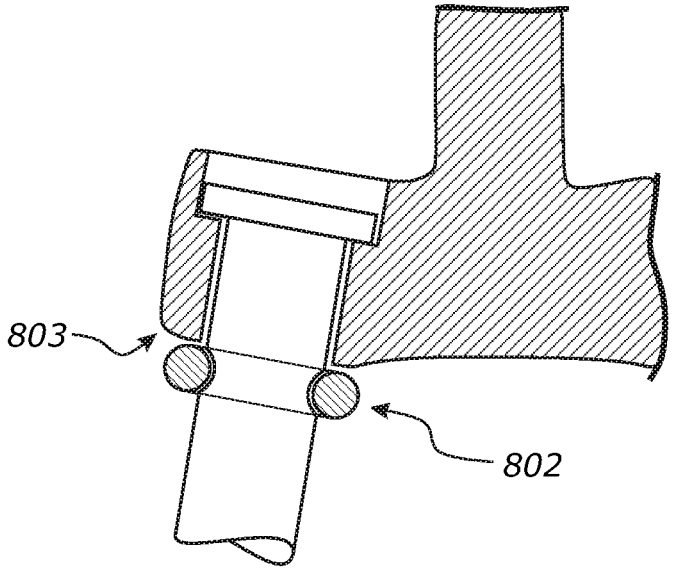
FIG. 3B shows a view of the first member and anchor engaged and an O-ring located in a rebate positioned to help retain the anchor in the engaged condition with the receptacle.
Figure 3C:
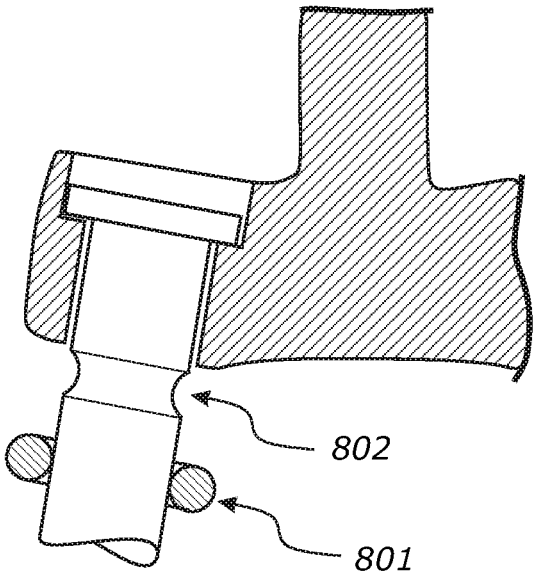
FIG. 3C shows the O-ring of FIG. 3B having been moved to allow the anchor to be removed from the receptacle.
Figure 3D:
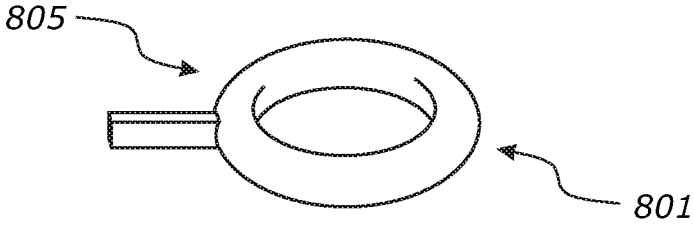
FIG. 3D shows the O-ring and an optional tab for ease of manipulation of the O-ring.

In various embodiments of the invention, a bias may be provided to bias the anchor into locked engagement with the receptacle. For example, in the embodiment of FIGS. 1 to 4, a bias such as by a spring 800 such as a leaf spring may be provided to act in the direction of the arrow 13 on the anchor, to hold it in locking engagement with the receptacle as shown in FIG. 3A. The use of such a bias may be desirable to act as a further safety or security of the anchor device, to help ensure that under regular use forces and vibrations, the anchor is not inadvertently released from the receptacle. In an alternative form selective retention of the anchor may be ensured by the use of a retainer located on the other side the anchor to the projections 9 and may for example be an O-ring 801. The O-ring may register in or against a registration surface of the anchor. The registration surface may be a lip or ledge or rebate 802 of the anchor 5. The registration surface such as the rebate is located so that the O-ring, when registered at the rebate, can act against the surface 803 of the first member to help retain the anchor in its engaged condition. The O-ring can be rolled or pried from its registration at the rebate 802 as seen in FIG. 3C to allow the anchor to release. The O-ring 801 may include a tab 805 for easy manipulation by a person.

Figure 7A:
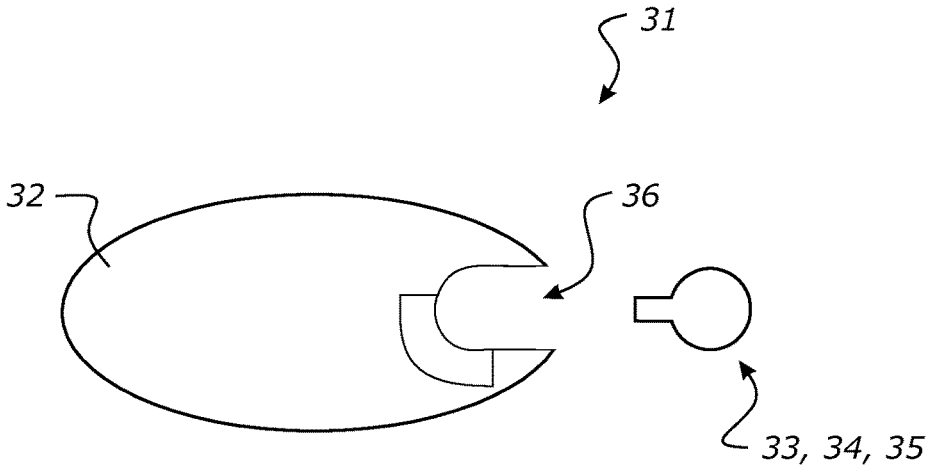
FIGS. 7A-C show stages of the reception of an anchor with a first member, and the engagement of the anchor with the first member.
Figure 7B:
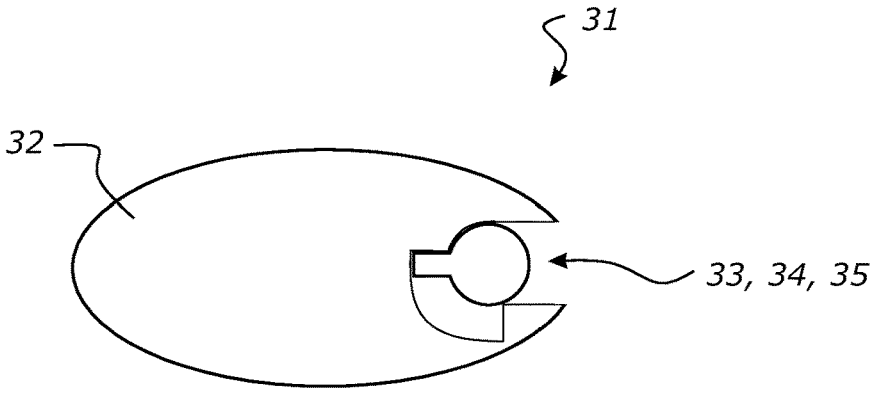
Figure 7C:
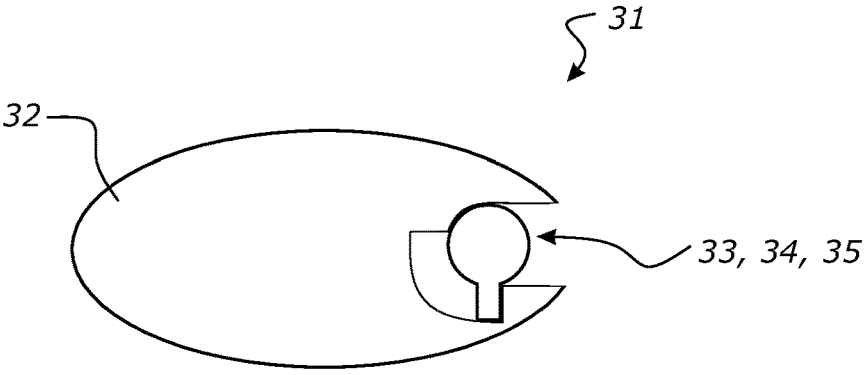

FIGS. 7*a* to 7*c* illustrates another embodiment of an anchor device 31 according to the invention. Shown are an anchor device 31, comprising a first member 32 and a chicken loop 33. The chicken loop 33 has a first end 34 having an anchor 35 substantially corresponding to the anchor shown in FIGS. 5 and 6.

In the embodiment of FIGS. 7*a* to 7*c*, the anchor 35 engages with the receptacle 36 by not just an insertion into the receptacle, but by an insertion and then a rotation of the anchor 35 within the receptacle 36. For example, as seen in FIG. 7*b* the anchor 35 has been inserted into the first member 32. As seen in FIG. 7*c*, the anchor 35 has been rotated through a predetermined angle, as shown being approximately 90 degrees. The anchor 35 is then engaged with the first member 32, so as to present an interference to the movement of the first member 32 relative the anchor 35 in direction out of the page.

The rotation of the anchor 35 as shown between FIGS. 7*b* and 7*c* may provide further security against inadvertent unlocking of the anchor 35 within the receptacle 36.

FIGS. 8*a* to 8*d* illustrate a further embodiment of an anchor device 41 according to an embodiment of the invention. FIGS. 8*a* to 8*d* show top-down views of a first member 42 and a chicken loop 43, showing only the anchor 45 of the first end 44 of the chicken loop. FIGS. 8*a* to 8*d* show a process of insertion of the anchor 45 into a receptacle 46 of the first member 42 of the anchor device 41.

The first member 42 also comprises a bias element 14.

Figure 8A:
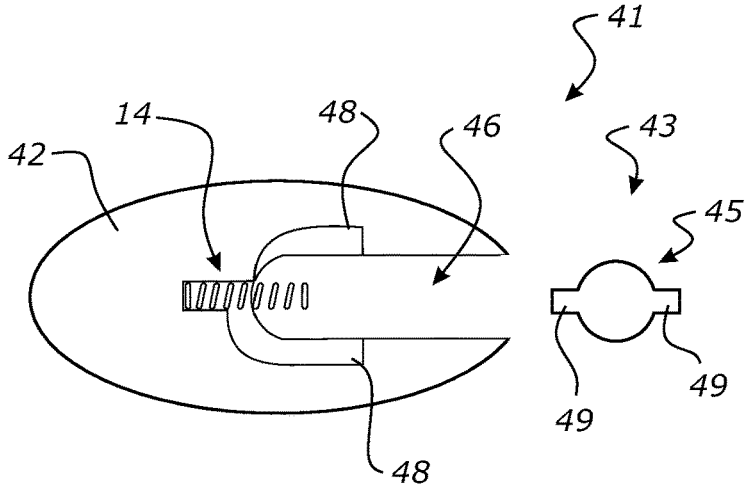
FIGS. 8A-D show stages of the reception of an anchor with a first member, and the engagement of the anchor with the first member.
Figure 8B:
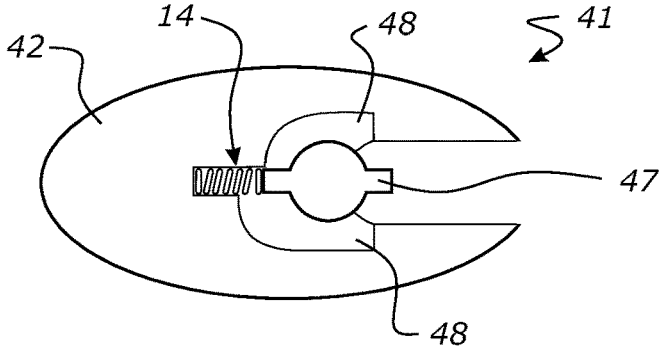
Figure 8C:
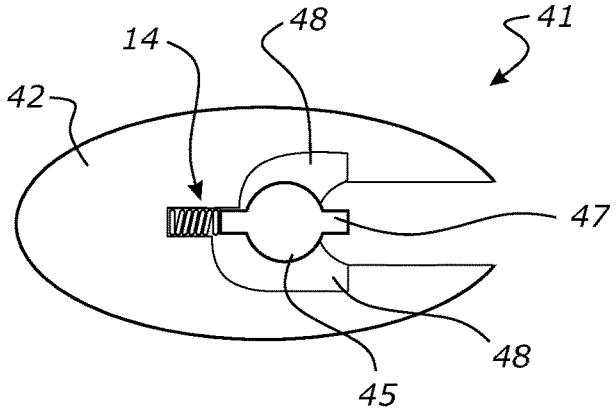

From FIG. 8*a* to FIG. 8*b*, the anchor 45 is moved into the receptacle 46, at least partially against the bias of the bias element 14. The anchor 45 must be inserted into the receptacle 46 until the trailing projection 47 of the anchor is fully within the slot 48, as is shown in FIG. 8*c*.

The anchor 45 may then be rotated within the receptacle 46 and slot 48, so that the projections 49 of the anchor 45 engage with the limits of the slot 48, preferably under the bias of the bias element 14.

Figure 8D:
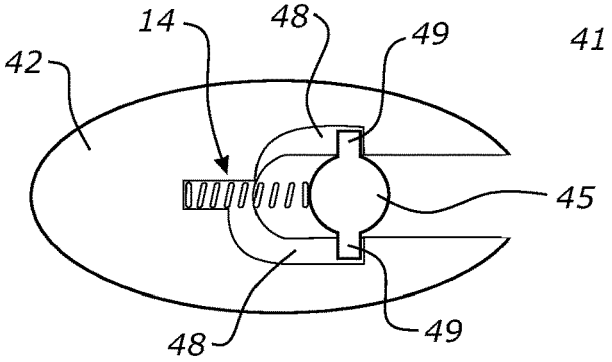

As seen in FIG. 8*d*, the bias element 45 preferably acts on the anchor 45 in its engaged condition to help retain the anchor 45 engaged with the first member 42.

The chicken loop 43 as seen in FIGS. 8*a* to 8*d* extends into the page, and when the anchor 45 is received by the first member 42 the first end 44 of the chicken loop is at least partly within the slot 11 of the first member 42.

In some forms the first end of the chicken loop is to be received at the receptacle of the first member by a discrete maneuvering of the first end relative to the first member. The first end may then be engaged with the receptacle of the first member by a second discrete maneuvering of the first end relative to the first member. Each of the first and second discrete maneuverings may be of either translational, rotational or combined translational and rotational movements of the anchor relative to the first member.

For example, as seen in FIGS. 1 to 4 the anchor 5 is engaged with the receptacle 6 by a first longitudinal insertion in the direction of the arrow 10, followed by a rotation of the anchor 5, and finally a small movement of the anchor 5 in a direction opposite the arrow 10. This direction opposite is in the same direction of tension of the anchor device in normal use conditions of the kite and anchoring device.

As described in relation to various embodiments, in some preferred forms the anchor may be received at the receptacle by a twist-lock action relative to the first member.

In various forms the anchor and receptacle of the anchor device of the invention together define a bayonet connector. For example, the anchor may define a male part of the bayonet connector, and the receptacle may define a female part of the bayonet connector. Such a configuration is seen in FIGS. 1 to 4, for example.

In some embodiments the anchor when engaged within the receptacle may be in a condition of material interference.

As a form of additional security of the engagement of the anchor and receptacle, the anchor device may comprise a bias element to bias the anchor into its locked engagement with the first member.

Where such a bias is provided for, a removal of the anchor from an engagement with the receptacle may comprise a movement against the bias of the anchor into its engagement with the receptacle. Similarly, a receiving of the anchor by the receptacle in such configuration may involve a movement against the bias of the anchor into engagement with the receptacle.

According to another aspect the invention relates to a method of engaging a chicken loop of a traction kite anchoring device. The anchoring device comprises a chicken loop to be engaged at an anchor at a first end of the chicken loop with a first member. The present invention allows a user to own a plurality of chicken loops (where different or the same) and replace the chicken loop with ease.

The method comprises step of translating the anchor relative the first member in a direction and optionally against the bias of the first member and the anchor. For example, see the configuration of FIGS. 8*a* to 8*c*. The method comprises the further step of rotating the anchor relative the first member.

For example, as is shown between FIGS. 8*c* and 8*d*. According to the method, the anchor is then retained in an engagement with the first member bias of the anchor device. For example, this is as shown in FIG. 8*d*.

The method may comprise a further step of translating the anchor relative to the first member in a direction opposite the first direction to engage the anchor with the first member. For example, this comprises movement of the anchor 5 in the direction of the arrow 13 as shown in FIG. 4.

The steps of the method of engaging the chicken loop are preferably performed by a user using their hands. No tools are required to be used. In addition, it is preferred that the steps of the method are to be performed by a user using their hands, exclusive of any other tools.

According to another aspect, the invention relates to a method of disengaging a chicken loop of a traction type anchor device. The traction kite anchoring device comprises a chicken loop which is engaged at an anchor of a first end of the chicken loop with a first member.

The method of disengaging comprises the steps of rotating an anchor relative to the first member, and translating the anchor relative to the first member in a direction opposite a first direction to separate the anchor from the first member.

For example, this is as shown by the sequence of FIG. 4, followed by FIG. 3, followed by FIG. 2. However, in the configuration of FIG. 4 the method of disengaging may comprise a further initial step of translating the anchor from five relative to the first member 2 in the first direction (being a direction opposite the arrow 13).

As in relation to the previously described method of engaging a chicken loop, it is preferred that the steps of the method of disengaging the chicken loop are able to be performed by a user using their hands, and further preferably can be performed by a user using their hands exclusive of any other tool.

According to another aspect, the invention relates to a kit of parts for use as an anchoring device for a traction kite. The anchoring device is to be used for attachment to a harness worn by a user to transfer force from a kite to the user.

The kit of parts comprises a first member which is connected with or is for connection to an end of at least one line connected to a traction kite. The kit of parts also comprises a chicken loop. The chicken loop has a first end and a second end, each end for association with the first member so as to, between the ends, present a loop for attachment to the harness to be worn by a user.

According to the invention, the first end of the chicken loop is able to be received at and engage with a receptacle of first member in a releasable and cool with manner. By this engagement the anchor may present an interference to movement of the first member in the direction of a force by a traction force by the kite.

In another aspect, invention relates to a kite anchor device comprising a first member at the end of at least one line connected to a kite, and a chicken loop. The first member and the chicken loop are engaged to each other or engageable to each other by way of a bayonet connection.

In other forms, the invention relates to a tool less changeable chicken loop for a kite anchoring device. The tool less changeable chicken loop comprises a first end configured for a releasable and tool less bayoneted connection to the kite anchoring device.

Figure 9:
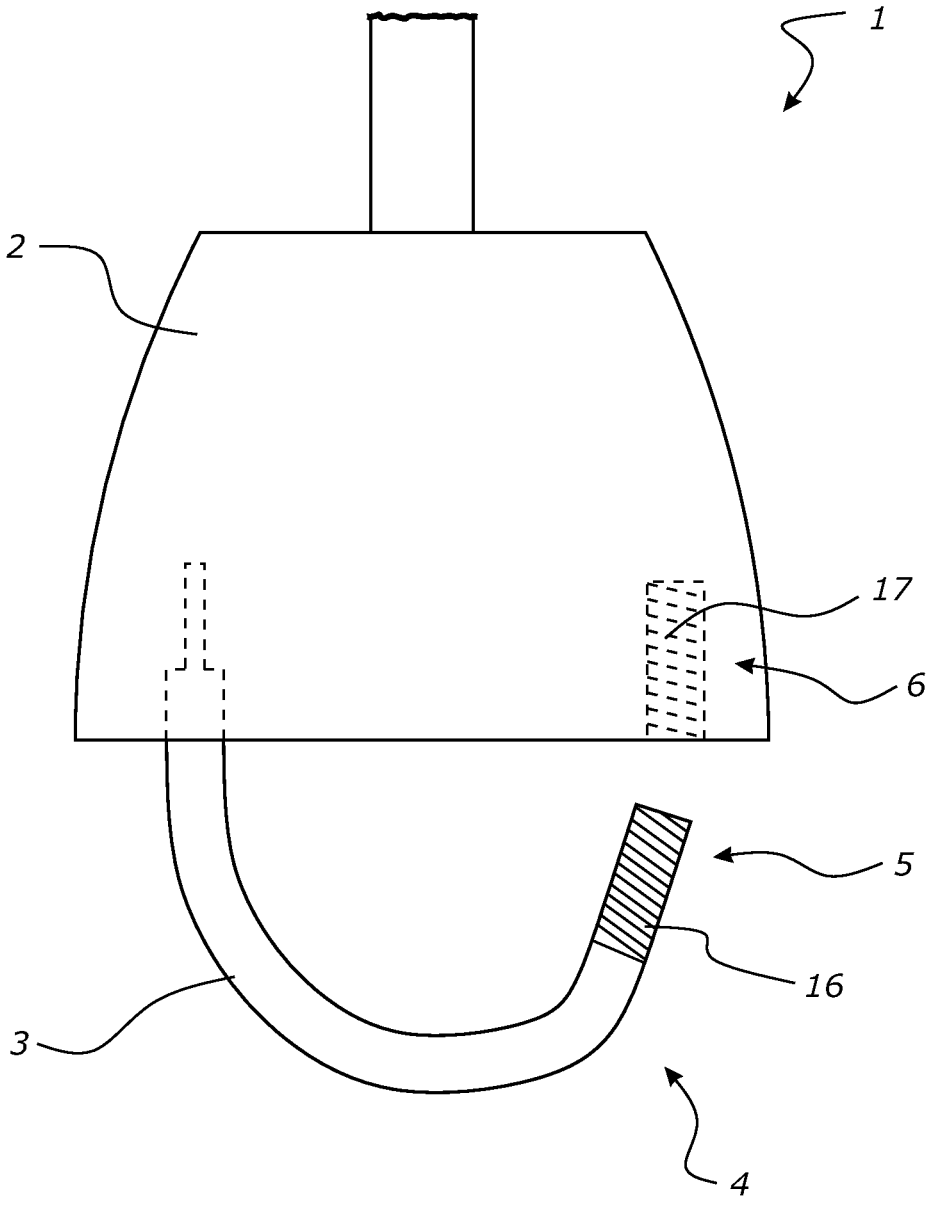
FIG. 9 shows a traction kite anchoring device according to another embodiment of the invention.

FIG. 9 shows another embodiment of an anchor device 1 according to the invention. The anchor device 1 of FIG. 9 comprises a chicken loop 3 having threads 16 at a first end 4. The threads 16 form the anchor 5 of the first end 4.

The first member 2 comprises corresponding threads 17. The threads 16 of the first end for the chicken loop 3 are able to be threadingly engaged with the threads 17 of the receptacle 6 of the first member 2. In this manner the first end 4 may be releaseably and tool less engaged and disengaged with the first member 2. When engaged with the first member 2, the anchor 5 of FIG. 9 presents an interference of the movement of the first member 2 relative to the anchor 5 in a direction of the arrow 10.

Figure 10A:
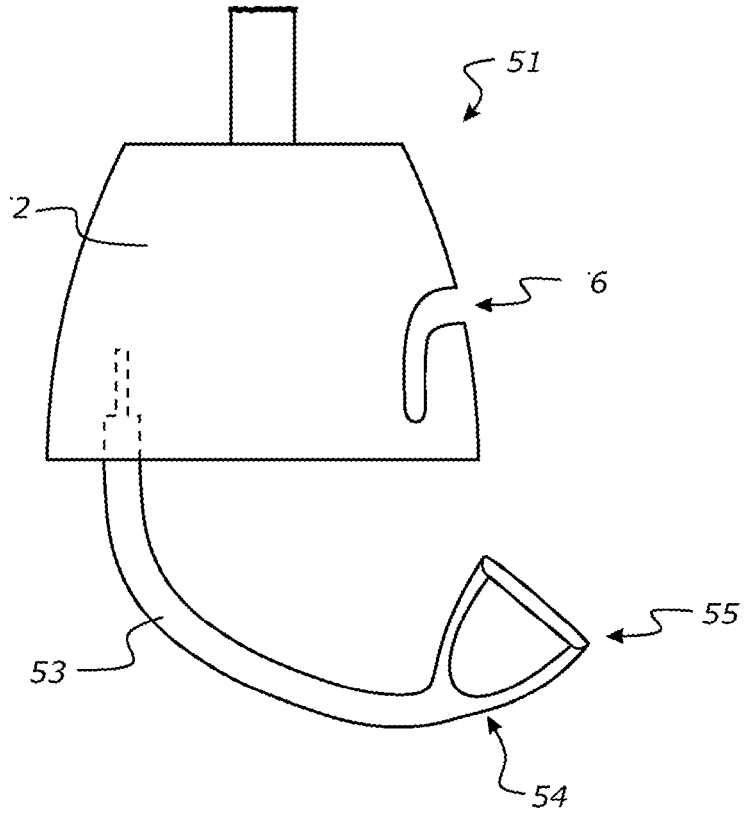
FIGS. 10A and 10B show views of another embodiment of a traction kite anchoring device.
Figure 10B:
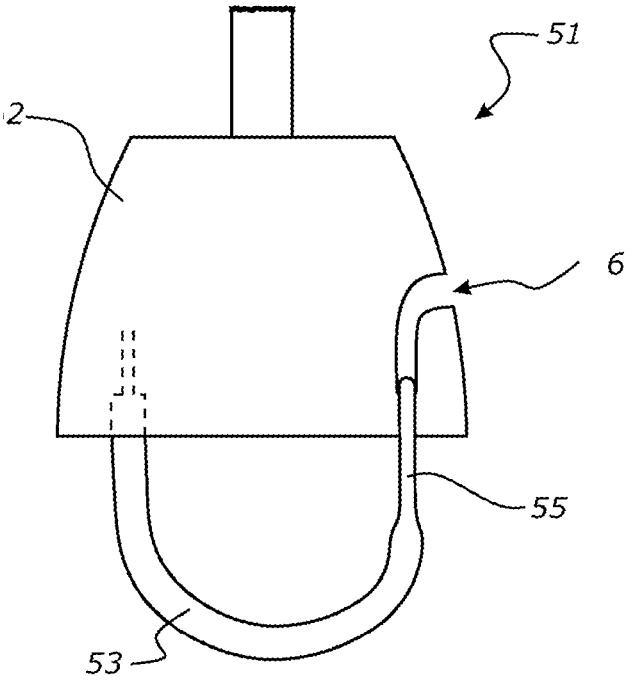

FIGS. 10*a* and 10*b* show an anchor device 51 according to another embodiment. As seen in FIG. 10*a* the anchor device 51 comprises a first member 2 having a receptacle 6 in the form of a slot or channel. The anchor device 51 comprises a chicken loop 53 having a first end 54 and an anchor 55. The anchor 55 is in the form of a yoke which is able to be received within the slot or channel of receptacle 6.

FIG. 10*b* shows the anchor 55 engaged with the first member 2 within the receptacle 6.

As previously described, the anchor device 51 of the embodiment of FIGS. 10*a* and 10*b* may additionally comprise a bias to bias the anchor 55 to its engaged condition with the first member 2.

The anchoring device of the invention is for attachment between a harness worn by a user, and a traction kite. The anchor device acts to transfer force from the kite to the user. In preferred forms the transfer of the force from the anchor device to the user maybe by the chicken loop of the anchor device. The chicken loop may be engaged at the first end having an anchor, as described, and also releasably connected to the anchor device at a second end of the chicken loop. The user's harness may then connect to the loop formation of the chicken loop between its first and second ends.

The end or ends of the at least one line of the traction kite which are full connection to the anchor device are preferably the load bearing lines of the traction type.

Figure 11:
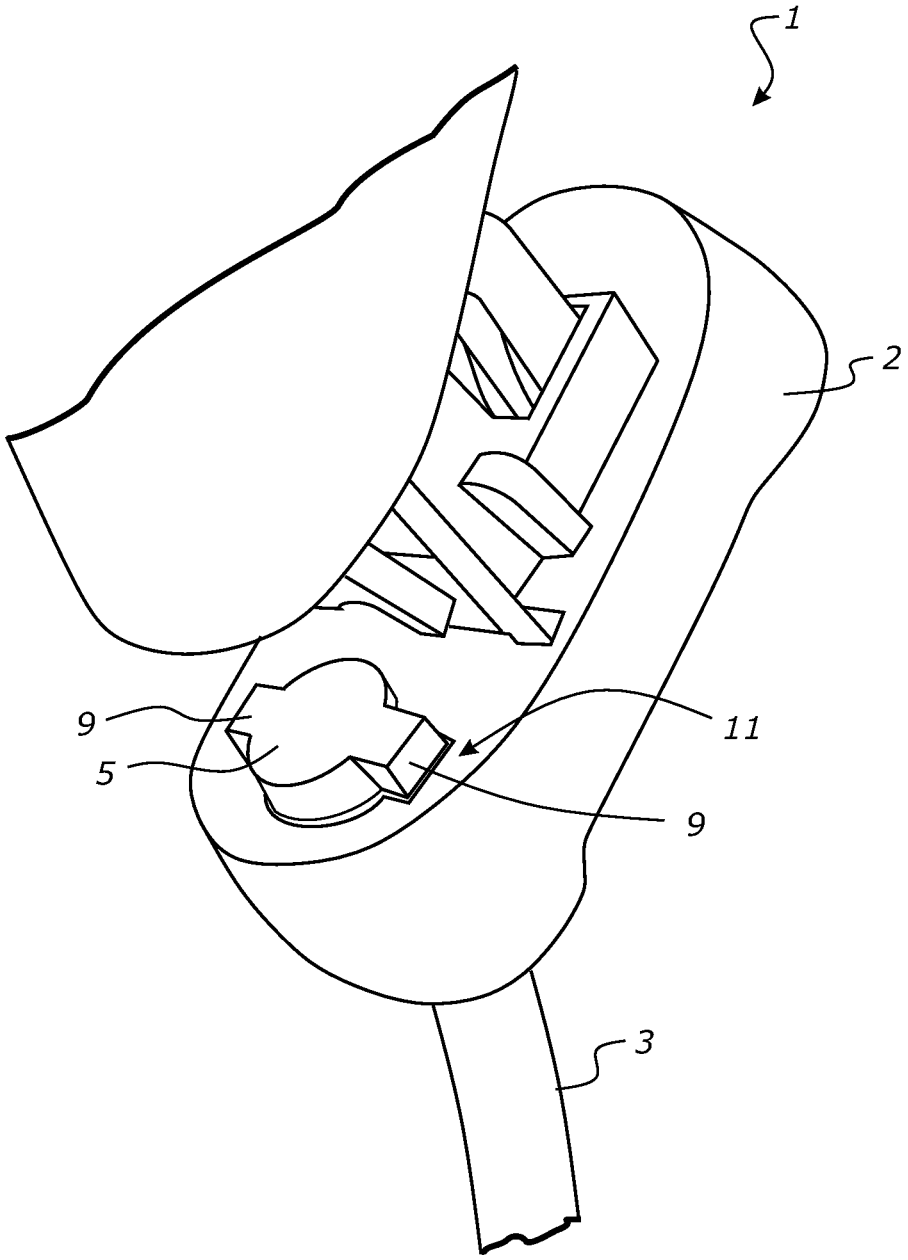
FIG. 11 shows a view of another embodiment of a traction kite anchoring device.

Another embodiment of an anchoring device which is able to toollessly be geometrically locked with an end of a chicken loop is shown in FIG. 11. In this embodiment the anchor 5 is to be fed into the receptacle 6 from the end (not shown) of the chicken loop 3 opposite the anchor 5. For example, in FIG. 11 the anchor 5 is being fed into the receptacle 6 in the direction of the arrow 13.

The receptacle 6 comprises channels 12 to receive the anchor 5 and its bayonet projections 9, but the channels do not extend fully through the body of the first member 2. By this way the anchor 5 may be locked against further movement relative the first member 2 in the direction of the arrow 13, and the first member 2 locked against movement in the opposite direction relative to the anchor 5.

While shown as primarily comprising various forms of bayoneted connections, the anchor is received and engaged with a receptacle in a releaseable and tool less manner.

Figure 10C:
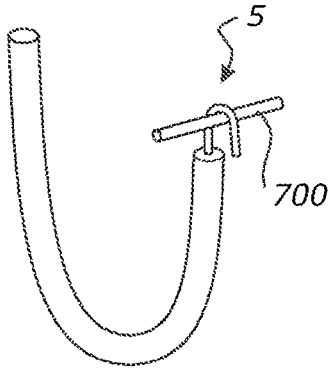
FIG. 10C shows a chicken loop with a hook portion at its end for engagement onto a pin of the first member.

Whilst in the preferred form the first member provides a receptacle for the anchor, it is envisaged that alternative ways of securing an anchor of the chicken loop may be provided for. Hence in a broader sense the receptacle may be an anchor receiver provided by the first member to releasably secure the anchor. This anchor receiver may be a pin supported at each end and the anchor may be a hook formation that can latch over the pin 700 as seen in FIG. 10C. A spring clip or other device may be used in conjunction to help retain the hook 5 to the pin 700.

Where in the foregoing description reference has been made to elements or 5 integers having known equivalents, then such equivalents are included as if they were individually set forth.

Although the invention has been described by way of example and with reference to particular embodiments, it is to be understood that modifications and/or improvements may be made without departing from the scope or spirit of 10 the invention.

In addition, where features or aspects of the invention are described in terms of Markush groups, those skilled in the art will recognise that the invention is also thereby described in terms of any individual member or subgroup of members of the Markush group.

The invention claimed is:

1. A traction kite anchoring device for attachment to a harness worn by a user to transfer force from a traction kite to the user, the traction kite anchoring device comprising a first member at an end of at least one line connected to said traction kite and a chicken loop for attachment to said harness and releasably connected to said first member, wherein the chicken loop has a first end comprising an anchor able to be received and secured at an anchor receiver of the first member in a releasable and tool-less manner, and wherein the anchor becomes secured at an arc-shaped receptacle of the anchor receiver allowing rotation of the anchor within the arc-shaped receptacle.

2. The traction kite anchoring device as claimed in claim 1, wherein the anchor and the anchor receiver are shaped and configured to mutually provide an interference fit when the anchor is received and secured at the anchor receiver to prevent movement of the first member relative the anchor in a direction of said force towards the user when the anchor device is in tension.

3. The traction kite anchoring device as claimed in claim 1, wherein the anchor receiver is the arc-shaped receptacle of the first member.

4. The traction kite anchoring device as claimed in claim 1, wherein the first end is engaged with the arc-shaped receptacle of the first member in a directional interference fit.

5. The traction kite anchoring device as claimed in claim 1, wherein the first end is received at the arc-shaped receptacle of the first member by a first maneuvering of the first end relative the first member, and the first end is secured at the arc-shaped receptacle of the first member by a second maneuvering of the first end relative the first member.

6. The traction kite anchoring device as claimed in claim 1, wherein the anchor is a) received at the arc-shaped receptacle by a first translational movement of the anchor relative the first member, and b) secured at the arc-shaped receptacle by i. a rotational movement of the anchor relative the first member, and ii. a second translational movement of the anchor relative the first member, being a translational movement opposite the first translational movement.

7. The traction kite anchoring device as claimed in claim 1, wherein the anchor becomes secured at the arc-shaped receptacle by a twist-lock action of the anchor relative to the first member.

8. The traction kite anchoring device as claimed in claim 1, wherein the anchor and the arc-shaped receptacle of the first member together define a bayonet connector.

9. The traction kite anchoring device as claimed in claim 1, wherein a bias is provided to bias the anchor, once engaged with the anchor receiver, into engagement with the anchor receiver.

10. The traction kite anchoring device as claimed in claim 9, wherein a removal of the anchor from engagement with the anchor receiver comprises a movement against the bias of the anchor into engagement with the anchor receiver.

11. The traction kite anchoring device as claimed in claim 1, wherein the chicken loop has a second end that is able to be engaged in a quick release manner to the first member.

12. A method of engaging and/or replacing a chicken loop of a traction kite anchoring device, the anchoring device comprising a chicken loop to be engaged at an anchor of a first end of the chicken loop with a first member, wherein the anchor becomes secured at an arc-shaped receptacle of the anchor receiver allowing rotation of the anchor within the arc-shaped receptacle, the method comprising the steps of a) removing any previously used chicken loop, b) translating the anchor relative the first member in a first direction, and c) moving the anchor relative to the first member, wherein the anchor when in its engaged condition is encouraged to be retained in engagement with the first member by a bias provided from the first member on the anchor.

13. The method as claimed in claim 12, wherein the first and/or second motions are against a bias provided from the first member on the anchor.

14. He method as claimed in claim 12, wherein the steps of the method are performed by a user using their hands, exclusive of any other tool.

15. A kit of parts for use as an anchoring device for a traction kite, the anchoring device for attachment to a harness worn by a user to transfer force from a kite to the user, the kit of parts comprising;

a first member connected with or for connection to an end of at least one line connected to said traction kite, and a chicken loop comprising a first end and a second end, each end for association with the first member so as to, between the ends, present a loop for attachment to said harness worn by a user, wherein the first end is able to be received at and engaged with a first end receiver of the first member in a releasable and tool-less manner, and wherein an anchor becomes secured at an arc-shaped receptacle of an anchor receiver allowing rotation of the anchor within the arc-shaped receptacle.

16. The kit of parts as claimed in claim 15, wherein the first end is engaged with the first member in a bayonet fitting manner to effect the releasable toolless engagement.

17. A kite anchoring device comprising a first member at the end of at least one line connected to a kite and a chicken loop, the first member and the chicken loop engaged or engageable to each other by way of a bayonet connection, and wherein an anchor becomes secured at an arc-shaped receptacle of an anchor receiver allowing rotation of the anchor within the arc-shaped receptacle.

18. The kite anchoring device as claimed in claim 17, wherein a bias is provided to bias the anchor into engagement with the arc-shaped receptacle.

19. The kite anchoring device as claimed in claim 17, wherein one of the anchor and the arc-shaped receptacle comprise a bias element for biasing the anchor into engagement with the arc-shaped receptacle.

20. The kite anchoring device as claimed in claim 17, wherein the anchor defines a male part of the bayonet connector and the arc-shaped receptacle defines a female part of the bayonet connector.

21. A toollessly-changeable chicken loop for a kite anchoring device, the chicken loop comprising a first end configured for a releasable and tool-less bayonet connection to the kite anchoring device, and wherein an anchor becomes secured at an arc-shaped receptacle of an anchor receiver allowing rotation of the anchor within the arc-shaped receptacle.

22. A traction kite anchoring device for attachment to a harness worn by a user to transfer force from a traction kite to the user, the traction kite anchoring device comprising a first member at an end of at least one line connected to said kite and a chicken loop for attachment to said harness and releasably connected to said first member, wherein the chicken loop has a first end comprising an anchor able to be locked and unlocked to and from the first member in a manner that is tool-less and/or does not require the use of a grub screw or bolt or machine screw, and wherein the anchor becomes secured at an arc-shaped receptacle of an anchor receiver allowing rotation of the anchor within the arc-shaped receptacle.

* * * * *